US005433597A

United States Patent [19]

Palma et al.

[11] Patent Number: 5,433,597

[45] Date of Patent: Jul. 18, 1995

[54] ROTARY KILN INLET

[75] Inventors: Pedro G. Palma, Lippetal-Hovestadt; Karl Krutzner, Beckum, both of Germany

[73] Assignee: Krupp Polysius AG, Beckum, Germany

[21] Appl. No.: 276,762

[22] Filed: Jul. 18, 1994

Related U.S. Application Data

[63] Continuation of Ser. No. 177,237, Jan. 4, 1994.

[30] Foreign Application Priority Data

Jan. 14, 1993 [DE] Germany ..... 43 00 827.5

[51] Int. Cl.[6] ..... F27B 7/32

[52] U.S. Cl. ..... 432/106; 432/80; 432/115

[58] Field of Search ..... 432/106, 109, 115, 103, 432/80

[56] References Cited

U.S. PATENT DOCUMENTS

| | | | |
|---|---|---|---|
| 3,436,061 | 4/1969 | Zinn | 432/106 |
| 3,547,417 | 12/1970 | Elkjaer | 432/106 |
| 3,580,554 | 5/1971 | Bushuev | 432/109 |
| 3,955,917 | 5/1976 | Kratochvil | 432/109 |
| 4,508,503 | 4/1985 | Ramesohl et al. | 432/106 |
| 5,174,750 | 12/1992 | Flading et al. | 432/115 |

FOREIGN PATENT DOCUMENTS

| | | | |
|---|---|---|---|
| 1037033 | 8/1983 | U.S.S.R. | 432/116 |

*Primary Examiner*—Henry C. Yuen
*Assistant Examiner*—M. Macy
*Attorney, Agent, or Firm*—Learman & McCulloch

[57] ABSTRACT

An inlet for a rotary kiln comprises a plurality of arcuate segments supported adjacent the inlet opening of the kiln to form a trough protruding through the inlet opening. Each of the segments is hollow and has an opening through which a cooling medium may be introduced.

15 Claims, 5 Drawing Sheets

ROTARY KILN INLET

This is a continuation of copending application Ser. No. 08/177,237 filed on Jan. 4, 1994.

The invention relates to a rotary kiln inlet through which flows material to be heat treated in the kiln.

BACKGROUND OF THE INVENTION

Rotary kilns are used for firing, sintering and other heat treatment of mineral materials, (for cement materials, lime or the like), ores and other bulk materials. The kiln feed which is to be subjected to heat treatment in the rotary kiln flows through the rotary kiln inlet into the inlet end of a rotary drum which rotates about its longitudinal axis. In these constructions which are generally known in the art a stationary inlet housing is arranged before the inlet end of the rotary drum in the direction of conveying the kiln feed. On this inlet housing there is generally fixed a chute-like material inlet trough, of which the front, lower end points in the direction of flow and protrudes into the material inlet opening of the rotary drum or the inlet end of the rotary drum, wherein with an approximately circular cross-section the base of this material inlet trough has a slight radial spacing from the peripheral edge of the material inlet opening. The base of the material inlet trough of these known constructions is generally produced in plate form in a welded or cast construction. It has always been found in practice that with these known rotary kiln inlets the troughs, and above all the bases thereof, are quite especially exposed to particular stresses originating both from wear due to the contact with the kiln feed and also due to thermal stresses and the resulting cracks.

The object of the invention is to provide a rotary kiln inlet which is distinguished by a particularly resistant construction of the material inlet trough and the base of the trough, and in which in particular a relatively simple installation (and thus also removal) of the trough base should be possible.

SUMMARY OF THE INVENTION

In the rotary kiln inlet according to the invention the base of the material inlet trough is composed of a plurality of hollow body segments of approximately box-type construction. Above all this creates a particularly good precondition so that the individual segments of the material inlet trough can be acted on in the interior thereof by a cooling medium (e.g. cooling gas, particularly cooling air, or cooling fluid, particularly cooling water) in a suitable manner. In the peripheral direction of the approximately circular cross-section of the trough these hollow body segments lie close alongside one another and in this case with suitable support on or in the stationary inlet housing they are each fixed by at least one outer fixing point on this inlet housing in such a way that, forming the base of the trough, they protrude sufficiently far into the material inlet opening at the inlet end of the rotary kiln to enable the kiln feed flowing down along the material inlet trough to be introduced sufficiently far into the inlet end of the rotary drum of the rotary kiln.

The individual hollow body segments are curved in an arc in an advantageous manner in the peripheral direction of the trough, i.e. they can be adapted in a suitable manner to the radius of the approximately circular material inlet opening at the inlet end of the rotary drum. In this case it is also particularly advantageous that these hollow body segments can be installed (and thus removed) from the rear face of the inlet housing opposite the interior of the kiln. This construction together with the outer fixing points of the hollow body segments create the extremely favourable possibility that if required a hollow body segment which is worn or otherwise damaged can be easily replaced axially from the outside (by contrast, in the constructions which are generally known in the art the plates of the trough base are installed or removed from the interior of the kiln, which is not only awkward and complicated, but also means working in a relatively dirty area).

In a particularly advantageous manner the hollow body segments of box-type construction are only open on their outer face (rear face) axially opposite the interior of the kiln, for the circulation of a cooling medium. Thus in a particularly favourable manner there is the possibility of forced cooling of the individual hollow body segments from the exterior, for example by cooling air with the aid of fans or also by other suitable cooling mediums and accessories in order to ensure an advantageous and adapted cooling of these hollow body segments and thus of the entire trough base from the interior, as from the side opposite the heating effect from the kiln.

The hollow body segments which are provided according to the invention for the trough base can basically be produced as a welded construction or as individual castings. In the latter case the production costs are particularly low, since with an advantageous construction all hollow body segments can be constructed in the same way using the same casting patterns, and it is even possible for the same sizes of hollow body segments to be used for different sizes (diameters) of rotary kilns.

In the practical construction of a rotary kiln inlet it is generally preferred for at least the surfaces which come into contact with the kiln feed to be lined with refractory material. With regard to the material inlet trough the surface thereof which serves as a conveying surface for the kiln feed and is inclined against the rotary drum is provided with a sufficiently thick lining of refractory material. In this case it is particularly advantageous if a web-like projection pointing into the interior of the kiln is integrally moulded on the front face of each hollow body segment approximately as an extension of the lower body wall and a sufficiently thick lining of suitable refractory material is provided on the upper face of the material trough which is constructed for delivery of the kiln feed as well as on this web-like projection.

THE DRAWINGS

DETAILED DESCRIPTION

Figure 1:
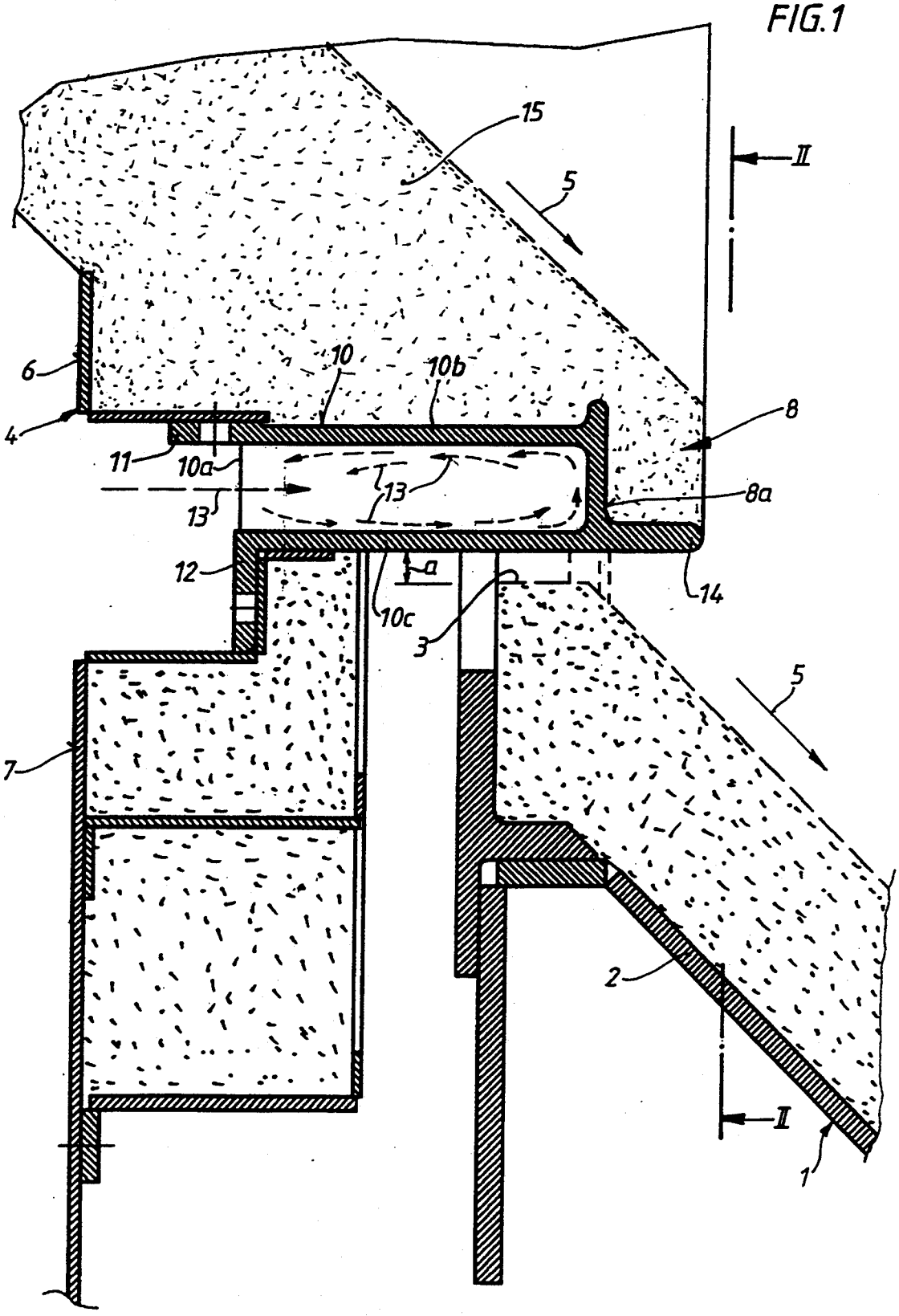
FIG. 1 shows a partial longitudinal sectional view though a rotary kiln inlet according to the invention.

First of all the general construction of the rotary kiln inlet according to the invention will be explained with the aid of FIGS. 1 and 2. This rotary kiln inlet is adapted for use with a rotary drum 1 which constitutes an important part of the associated rotary kiln, and is constructed and arranged in a manner which is known per se and accordingly is driven rotatably about its longitudinal axis. This rotary drum 1 has a conically tapering inlet end 2 with an approximately circular material inlet opening 3. Furthermore this rotary kiln inlet has an inlet housing 4 which is only partly indicated and is arranged upstream of the inlet end 2 of the rotary kiln in the direction of conveying the kiln feed (arrows 5). In the illustrated embodiment the inlet housing 4 contains an upper housing part 6 as well as a lower housing part formed by a type of tank 7.

A chute-like material inlet trough 8 is fixed on the inlet housing 4, and the front, lower end 8*a* of the said trough protrudes sufficiently into the material inlet opening 3 of the rotary kiln for material to be heat-treated in the rotary drum 1 to be conveyed—according to the arrows 5—into the inlet end 2 of the rotary drum. This material inlet trough 8 has a base 9 which, with an approximately circular cross-section (see front view of the trough base 9 in FIG. 2) is a small radial distance a from the peripheral edge of the material inlet opening 3.

Figure 2:
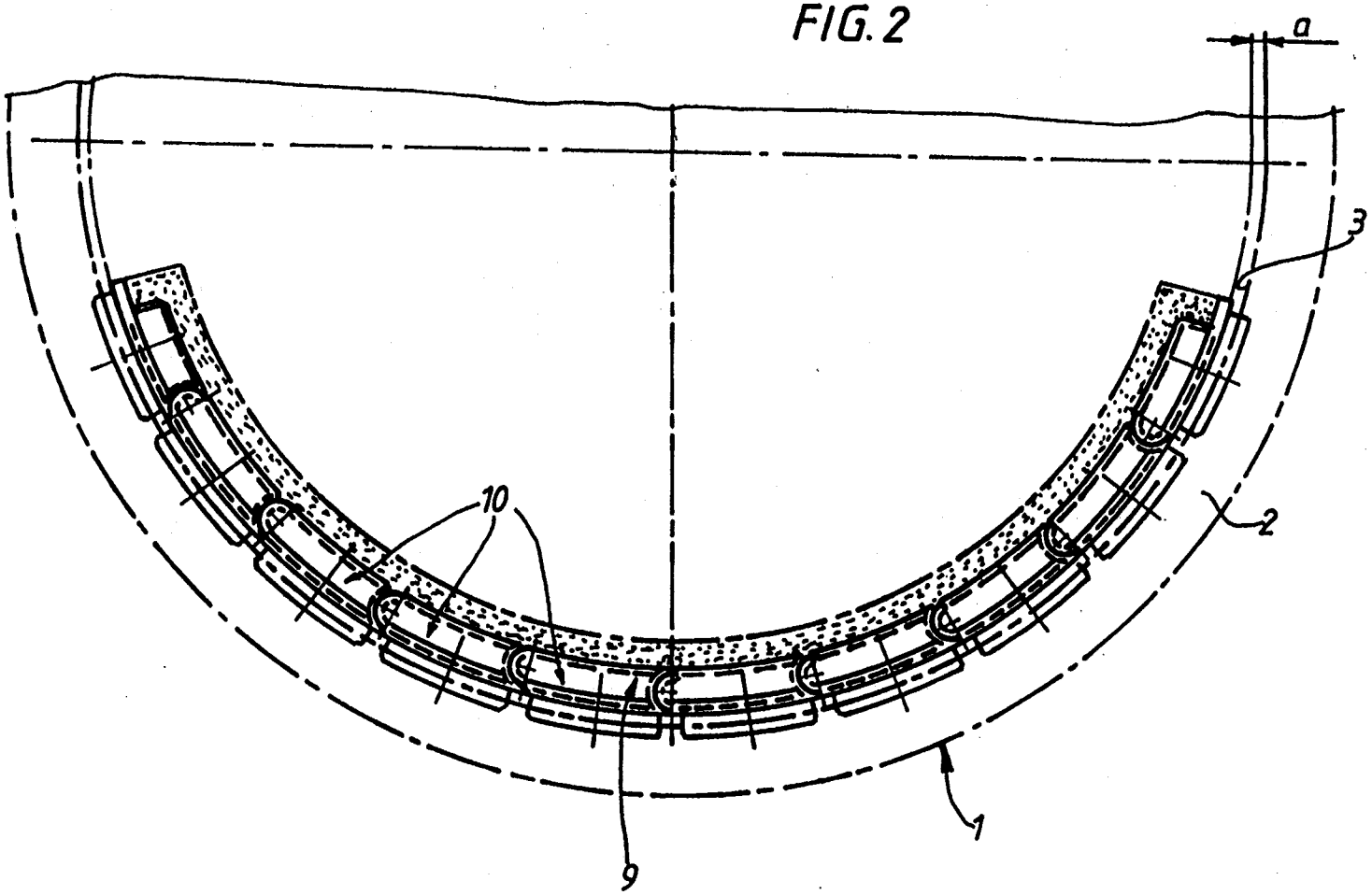
FIG. 2 shows a partial cross-sectional view approximately along the line II—II in FIG. 1.

It is particularly important that—as shown in FIGS. 1 and 2—the base 9 of the material inlet trough 8 is composed of a number of hollow body segments 10 of approximately box-type construction which lie close alongside one another in the peripheral direction of the circular cross-section of the trough base. As will to some extent be explained in greater detail, each hollow body segment 10 has at least one outer fixing point for fixing on the inlet housing 4. In the embodiment illustrated in longitudinal section in FIG. 1, the hollow body segment 10 has a rear horizontal fixing lug 11 with which it is fixed, preferably screwed, on the underside of the upper housing part 6, as well as a rear vertical lower fixing lug 12 which is fixed, preferably screwed on a corresponding vertical outer wall part of the housing tank 7. With this mounting each hollow body segment 10 is supported on an approximately horizontal surface of the lower housing tank 7 and from there projects freely through the material inlet opening 3 into the inlet end 2 of the rotary drum.

As will also be explained in greater detail below, all hollow body segments 10 can be acted on in their interior from the outside by a suitable cooling medium, as is indicated by broken arrows 13 in FIG. 1.

Figure 3:
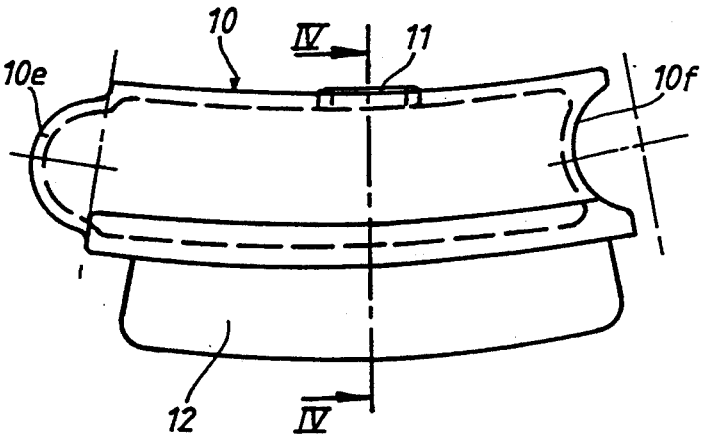
FIG. 3 shows a front view of a first embodiment of a hollow body segment.
Figure 4:
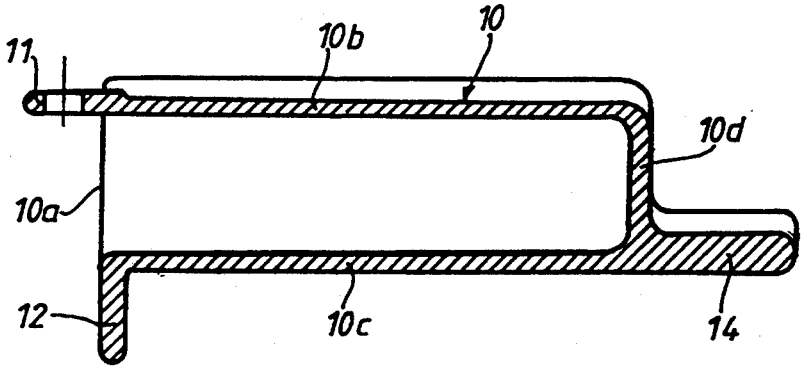
FIG. 4 shows a longitudinal sectional view through the hollow body segment, approximately along the line IV—IV in FIG. 3.
Figure 5:
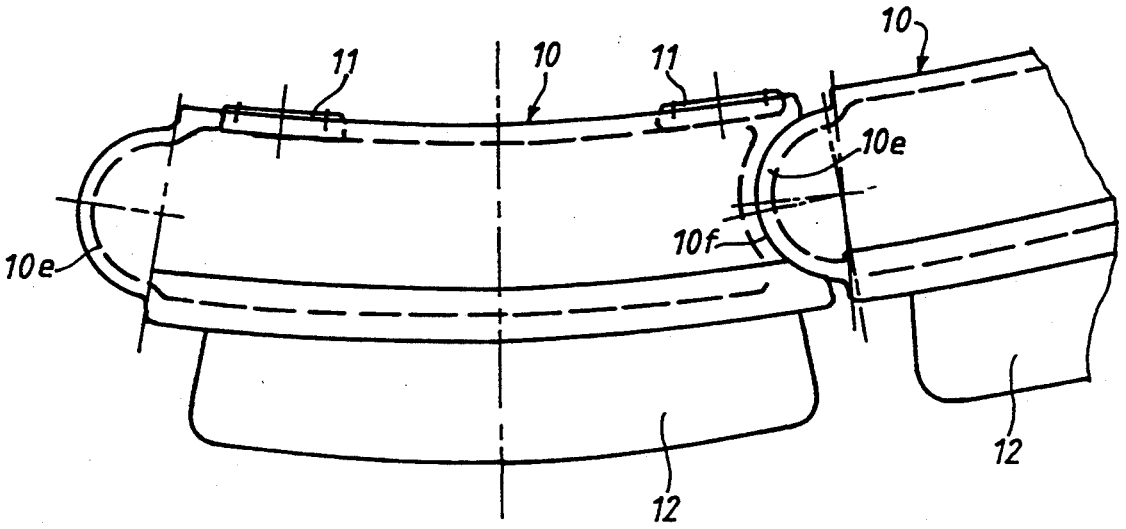
FIG. 5 shows a front view of hollow body segments lying close alongside one another in the peripheral direction, according to the construction of FIGS. 3 and 4.

The first embodiment of the hollow body segments 10 which are also used in FIGS. 1 and 2 are explained in somewhat greater detail with the aid of the individual illustrations in FIGS. 3 to 5.

In FIG. 3 (and also to some extent in FIG. 2) it can be seen that each hollow body segment 10 is curved in an arc in the peripheral direction of the trough. As the representation in FIGS. 1 and 4 show, it is generally preferred that the hollow body segments 10 are open only on their rear face or outer face 10*a* axially opposite the interior of the kiln (preferably on this entire rear or outer face). In this way a cooling medium such as air, water, or fluid may be introduced to and circulated through the interior of each hollow body segment 10, as is indicated in FIG. 1 by the arrows 13.

However, it can also be seen from the representation in FIG. 1 that the individual hollow body segments 10 of the trough base 8 can be relatively easily installed or removed from the rear face of the inlet housing 4 opposite the interior of the kiln.

The fixing lugs 11 and 12 which are intended for fixing the hollow body segments 10 on the inlet housing 4 are preferably cast integrally on the hollow body segments 10 if the latter, as preferred, are produced by casting. Accordingly it can be seen above all in FIGS. 1 and 4 that the top or upper body wall 10*b* of each hollow body segment 10 has the upper, outer fixing lug 11 projecting horizontally backwards on its rear edge and the lower or bottom body wall 10*c* has the lower fixing lug 12 bent approximately vertically downwards on its rear edge.

A web-like lip or projection 14 is integrally moulded on the front face or front wall 10*d* of each hollow body segment 10 so as to extend in prolongation of the bottom wall and beyond the front wall into the interior of the kiln. This web-like projection 14—as illustrated and preferred—is made of markedly thicker material than the lower body wall 10*c*, thus giving it a higher stability with respect to abrasion. As is usual per se, the upper face of the material inlet trough 8 which is constructed for conveying the kiln feed into the rotary drum 1 is provided with a sufficiently thick lining 15 of conventional refractory material. This lining 15 is preferably extended in the direction of conveying the kiln feed (arrows 5) in such a way that it is applied on the previously described projection 14 of each hollow body segment 10 so that these hollow body segments 10 have a particularly good protection both against mechanical and also chemical wear by the kiln feed and by the kiln exhaust gases.

Furthermore, in the embodiment of the hollow body segments 10 illustrated in particular with the aid of FIGS. 3 to 5 and also partly with the aid of FIG. 2, the two end walls 10*e* and 10*f*, which are aligned approximately in the direction of conveying the kiln feed (arrows 5), of each hollow body segment 10 are substantially constructed as partially cylindrical hollow body walls, as shown above all by FIGS. 3 and 5. Accordingly one end wall 10*e* has a concave cross-sectional shape and the other, opposite end wall 10*f* has a corresponding concave cross-sectional shape in such a way that—cf. FIG. 5—the end walls 10*f* and 10*e* which lie opposite one another of two adjacent hollow body segments 10 engage and fit in one another, i.e. the radius of curvature—viewed in the cross-section or in the front view of the hollow body—of the outer peripheral side of the convex first end wall 10*e* substantially corresponds to the radius of curvature of the second end wall 10*f*, so that these two end walls 10*e* and 10*f* of each pair of adjacent hollow body segments 10 can not only engage and fit into one another but also form a type of articulated joint. If in this construction of the hollow body segments 10 the latter lie close alongside one another to form the base of the trough 9 then the articulated interengagement of each pair of adjacent hollow body segments 10 allows adaptation of the circular cross-section of the material inlet trough or of the trough base 9 to different diameters of rotary drums within wide limits. This means, in other words, that hollow body segments 10 of the same size or with the same curvature can frequently be used for rotary drums 1 of markedly different sizes. This has a particularly advantageous effect both for the manufacture (e.g. casting patterns) and also for the storage of the replacement segments.

Figure 6:
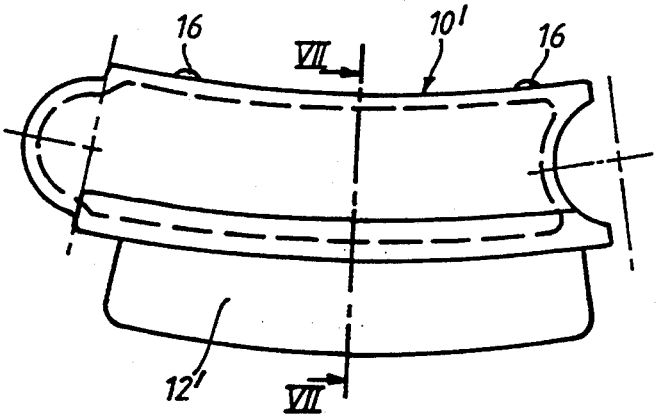
FIG. 6 shows a front view of a somewhat different embodiment of the hollow body segments.
Figure 7:
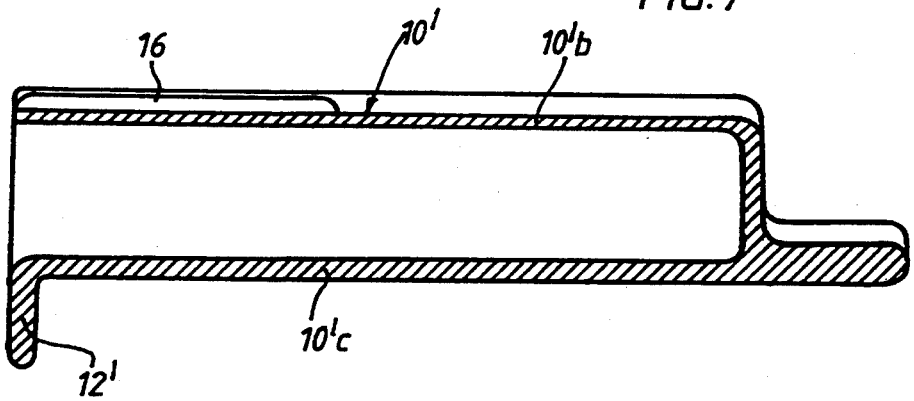
FIG. 7 shows a longitudinal sectional view along the line VII—VII in FIG. 6.

The embodiment illustrated with the aid of FIGS. 6 and 7 for the construction of the hollow body segments only represents a relatively slight variation on the construction described previously. A significant difference between this embodiment of the hollow body segment 10' shown in FIGS. 5 and 6 and the example described in detail above may be seen in the fact that a fixing lug 12' which is bent approximately vertically downwards is provided only on the rear edge of the lower body wall 10'c. This means that—with respect to the rotary kiln inlet according to FIG. 1—each hollow body segment 10' which extends sufficiently far in the peripheral direction is fixed, preferably screwed, on a vertically extending wall portion of the lower housing tank 7. However, in this case an adequate support of the lower body wall 10'c on the upper face of the tank 7 should be ensured.

For the upper body wall 10'b it is sufficient if this is merely sufficiently supported on the corresponding lower face of the upper housing part 6. So that this support can be achieved largely without swinging, it is preferable to provide on the upper face of the upper body wall 10'b of each hollow body segment 10' upwardly projecting contact projections 16 which can be individual, correspondingly distributed small bosses or merely two short ribs running in the longitudinal direction, as shown in FIG. 7. By the provision of these contact projections 16 good compensation for irregularities or inaccuracies on the lower face of the upper housing part 6 is possible. These contact projections 16 can be provided integrally, preferably cast, on the hollow body segments.

In this connection it should also be mentioned that the previously explained contact projections 16 can also be provided if required in the embodiment of the hollow body segments 10 described with the aid of FIGS. 1 to 5.

Figure 9:
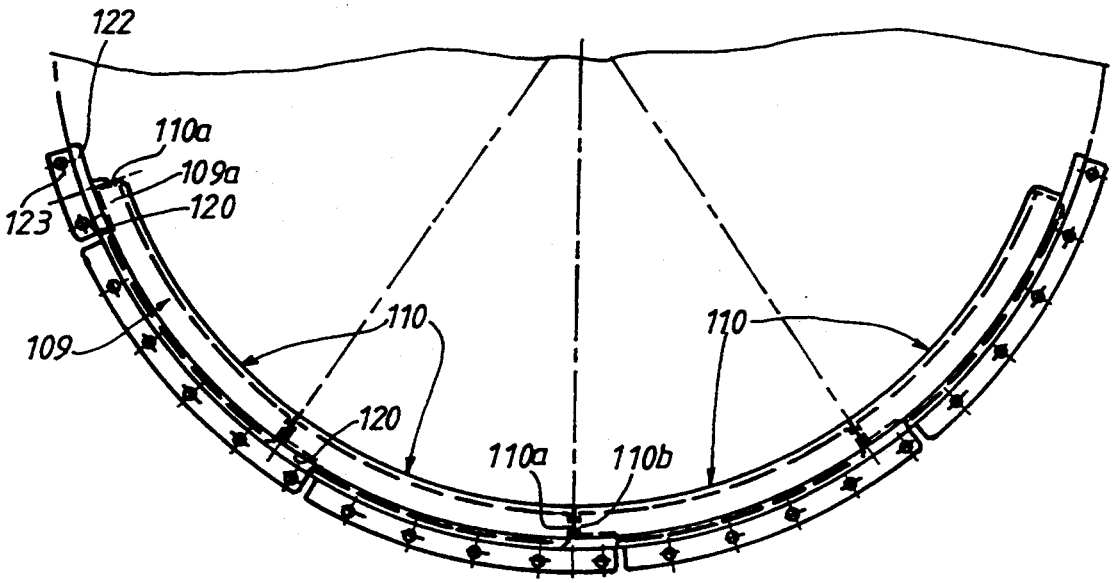
FIG. 9 shows a front view of a trough base composed of hollow body segments according to FIG. 8.
Figure 8:
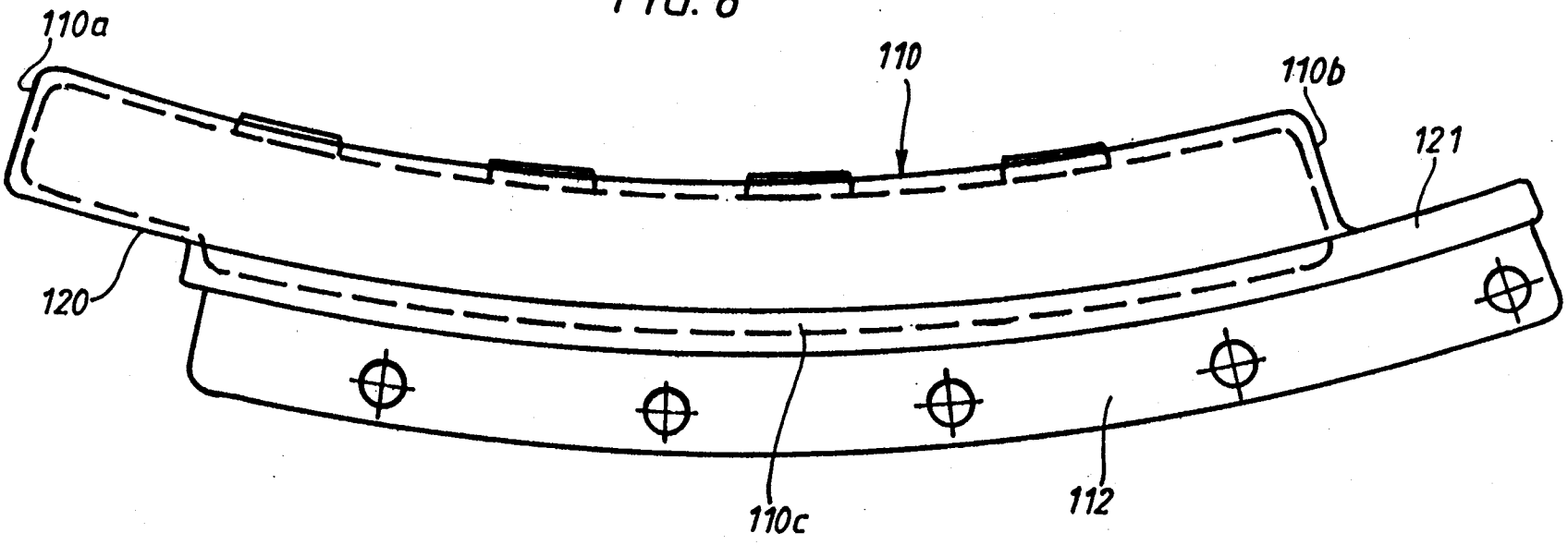
FIG. 8 shows a front view of a third embodiment for the hollow body segments.

A further possible construction of the hollow body segments which form the trough base is explained with the aid of FIGS. 8 and 9. In this case, too, the hollow body segments 110 are of approximately box-type construction and are curved in an arc in the peripheral direction of the trough. The longitudinal sectional form of each hollow body segment 110 can correspond exactly to the longitudinal sectional form shown in FIG. 4 or in FIG. 7. Accordingly a similar cooling of the hollow body segments 110 also takes place from the exterior.

From the front view in FIGS. 8 and 9 it can be seen that the two end walls 110a and 100b of each hollow body segment 110 which are aligned approximately in the direction of conveying the kiln feed (arrows 5 in FIGS. 1) are substantially flat. Accordingly when the hollow body segments 110 lie close alongside one another forming the trough base 109 of approximately circular cross-section, as shown in FIG. 9, then the walls 110a and 110b which point towards one another of each pair of adjacent hollow body segments 110 lie flat on one another.

Furthermore, in this embodiment (FIGS. 8 and 9) the lower body wall 110c and thus the lower fixing lug 112 which is integrally connected thereto and is bent vertically downwards is displaced relative to the hollow segment body in the peripheral direction of the trough (towards the right in FIGS. 8 and 9) in such a way that in the assembled state of the trough base 109 in the region below the walls 110a and 110b corresponding lower wall cut-outs 120 are formed (below the wall 110a) and wall projections 121 are formed (in the region below the wall 110b), and these wall projections and wall cut-outs of adjacent hollow body segments 110 overlap one another and thus ensure a reliable interengagement of adjacent hollow body segments.

However, in this case, in order for the trough base 109 formed by the hollow segments 110 last explained above to be accurately fitted together with the material inlet opening 3 of the rotary kiln inlet 2 (according to FIG. 1), it is advantageous to adapt the arcuate curvature or the radius of curvature of these hollow body segments 110 to the radius of the material inlet opening 3 of the inlet end 2 of the rotary kiln. Furthermore, in this construction (FIGS. 8 and 9) it is advantageous to fix an end segment plate 122 at the peripheral end 109a of the trough base 109—viewed in the peripheral direction of the trough base—at which a wall cut-out 120 would itself lie open in the region of the long side wall 110a so that this end segment plate partially engages under the last hollow body segment 110 located there—on the wall cut-out 120. This fixing of the end segment plate 122 can be carried out in the same way as in the hollow body segments 110 with the aid of a fixing lug 123 bend vertically downwards on the lower housing inlet tank 107.

We claim:

1. An inlet construction for a rotary drum rotatable about an axis and having at one end an inlet opening and a stationary support adjacent said opening, said inlet construction comprising a plurality of individual, hollow, arcuate body segments; and means mounting said segments side-by-side on said support in spaced relation to said drum so that said segments together form a trough protruding through the inlet opening of said drum, each of said segments having top, bottom, and side walls and a front wall facing in the direction of said drum, each of said segments being open at its rear end thereby providing an opening into said segment through which a cooling medium may be introduced, each of said segments having a lip projecting beyond said front wall in prolongation of said bottom wall.

2. The construction according to claim 1 wherein each of said segments has an upwardly concave upper surface.

3. The construction according to claim 1 including means for circulating a cooling fluid through each of said segments.

4. The construction according to claim 3 wherein said cooling medium is gas.

5. The construction according to claim 3 wherein said cooling medium is liquid.

6. The construction according to claim 1 wherein said mounting means comprises a lug substantially perpendicular to its associated segment.

7. The construction according to claim 1 wherein said mounting means comprises a lug extending substantially in prolongation of the associated segment.

8. The construction according to claim 1 wherein said lip provides means for supporting refractory material.

9. The construction according to claim 1 wherein one of the end walls of each of said segments has a concave recess therein and the other of which has a convex protrusion complementary to said recess, the protrusion of each segment being accommodatable in the recess of an adjacent segment.

10. The construction according to claim 9 wherein each of said protrusions is rockable when accommodated in the recess of an adjacent segment.

11. The construction according to claim 1 wherein the bottom wall of each of said segments has an offset portion displaced toward one side of said segment by such an amount that the offset portion of each segment may overlap a portion of an adjacent segment.

12. The construction according to claim 11 including an end plate underlying a portion of the bottom wall of one endmost segment.

13. The construction according to claim 1 wherein each of said segments has on its top wall an upwardly extending projection.

14. The construction according to claim 1 wherein each of said segments comprises a casting.

15. The construction according to claim 1 wherein each of said segments is formed from parts welded to one another.

* * * * *